United States Patent [19]

Ammon et al.

[11] Patent Number: 4,572,604

[45] Date of Patent: Feb. 25, 1986

[54] PRINTED CIRCUIT BOARD FINGER CONNECTOR

[75] Inventors: J. Preston Ammon; Harry R. Weaver, both of Dallas; Evan J. Evans, Plano, all of Tex.

[73] Assignee: Elfab Corp., Lewisville, Tex.

[21] Appl. No.: 649,026

[22] Filed: Sep. 10, 1984

Related U.S. Application Data

[63] Continuation-in-part of Ser. No. 411,516, Aug. 25, 1982, abandoned.

[51] Int. Cl.[4] ..... H01R 9/09

[52] U.S. Cl. ..... 339/176 MP; 339/206 R; 339/278 C

[58] Field of Search ..... 339/176 MP, 176 MF, 339/17 F, 17 LC, 276 SF, 278 C, 206 R, 59 M, 198 H

[56] References Cited

U.S. PATENT DOCUMENTS

| | | | |
|---|---|---|---|
| 3,020,510 | 2/1962 | Kuch | 339/17 |
| 3,413,594 | 11/1968 | Fernald et al. | 339/176 |
| 3,470,522 | 9/1969 | Lawrence | 339/14 |
| 3,474,521 | 10/1969 | Schwenn | 29/471.3 |
| 3,651,444 | 3/1972 | Desso et al. | 339/176 MP |
| 3,894,784 | 7/1975 | Clewes | 339/176 MP |
| 4,042,289 | 8/1977 | Heinonen | 339/17 LC |
| 4,327,954 | 5/1982 | Aldridge et al. | 339/176 MP |
| 4,343,528 | 8/1982 | Lucius et al. | 339/206 R |
| 4,423,916 | 1/1984 | Muehlhausen, II | 339/59 M |
| 4,484,792 | 11/1984 | Tengler et al. | 339/198 H |

FOREIGN PATENT DOCUMENTS

| | | | |
|---|---|---|---|
| 2334534 | 1/1974 | France | 339/17 LC |
| 2239839 | 2/1975 | France | 339/17 LC |
| 2254928 | 7/1975 | France . | |
| 2278220 | 2/1976 | France | 339/17 LC |
| 2732487 | 1/1978 | France | 339/17 LC |

OTHER PUBLICATIONS

"A Replacement for Printed Circuit Board Gold Plated Fingers" Rizzo, S. and Larkin, J. Texas Instruments.

*Primary Examiner*—John McQuade
*Attorney, Agent, or Firm*—John E. Vandigriff

[57] ABSTRACT

An electrical connector for the terminating edge of a printed circuit board to form the portion of the printed circuit board adapted to engage bowed portions of contact fingers in a conventional card edge connector. The finger connector insulator includes a slotted head section for receiving the board edge and a blade section for engaging a conventional card edge connector. Each side of the insulator contains a plurality of spaced contact receiving sleeves formed by parallel, transversely extending recesses which face outwardly on the blade and inwardly from each wall of the slotted head and which are connected by coaxial apertures formed in the head section.

5 Claims, 11 Drawing Figures

PRINTED CIRCUIT BOARD FINGER CONNECTOR

This application is a Continuation-in-part of prior U.S. application Ser. No. 411,516, filed 8/25/82, now abandoned.

FIELD OF THE INVENTION

The present invention relates to electrical connectors, and, more particularly, to a connector for attachment directly to circuitry disposed along the edge of a printed circuit board, said connector having parallel, transversely extending contacts for connecting the board circuitry to a printed circuit board edge connector.

HISTORY OF THE PRIOR ART

A conventional printed circuit board consists of a flat sheet of glass epoxy insulative material having solder coated conductive copper paths formed over one or both of the surfaces of the board. The conductive paths interconnect various circuit components which are mounted on the board and electrically interconnected to the conductive paths. Historically, interconnection between the various electrical points along the surface of the board has been made with circuitry exterior of the board by means of conventional printed circuit card edge connectors. That is, the printed circuit board, or card, generally has one edge along which is spaced a plurality of parallel, transversely extending conductive fingers formed by processes which include gold plating of the fingers. The fingers are electrically connected with various components on the circuit card and are adapted to be resiliently engaged by the contacts of a conventional printed circuit board edge connector when the edge is inserted into the connector card slot.

For maximum reliability the conductive fingers of the printed circuit board are conventionally plated with a noncorrosive metal such as gold. Plating of the conductive contact fingers requires that a printed circuit board, which is otherwise finished, be subjected to the additional operations of gold plating. Gold plating is relatively expensive in comparison with other techniques for adding gold to a metal surface in that substantial gold scrap is produced in the plating of edge fingers which must be further processed by expensive refining techniques to recover the gold. Moreover, gold plating of edge fingers requires a great deal of additional manufacturing time in the making of printed circuit boards and a great deal more gold than that which is actually deposited on the edge finger surfaces. Further, in the event any one of the gold plated fingers of the printed circuit board becomes damaged in the manufacturing process, the entire, often very expensive, board may have to be scraped.

The plated gold surfaces of conventional contact fingers of a printed circuit card edge are sometimes damaged by abrasive engagement with card edge connector contacts during repeated insertions and withdrawals. A gold contact surface formed by an in lay process is of higher reliability and much more abrasion resistant and, thus, results in a contact having a life of more connector insertion and withdrawal cycles than a contact having the same thickness of plated gold. It has also been observed that during insertion of a card edge into an edge connector not only are the plated fingers on the card abraded but insertion of the glass epoxy edge on the board, which is often beveled for ease of insertion into the connector, abrades the plated contact surfaces of the edge connector contacts. Therefore, replacing the leading edge which engages a card edge connector with a less abrasive material than glass epoxy would substantially reduce the wear on the card edge connector contacts.

Certain high reliability applications call for the use of metal-to-metal connectors for all printed circuit card interconnectors. One reason for this is the fact that plated edge fingers are formed from the same thin copper layer as the circuitry on the board which often may be on the order of only 0.002 inches in thickness. Such thin conductors are subject to failure under certain conditions. The edge finger connector of the present invention produces what is essentially a metal-to-metal interconnection with a printed circuit card edge connector substantially and inexpensively enhancing the reliability of conventional card edge interconnections.

An additional problem associated with conventional printed circuit card edge interconnection is that standard card edge connectors are made with standard spacings between opposed rows of bowed contacts and the thickness of the printed circuit board may vary. This is particularly prevalent with the thicker, stacked or multi-layer boards. Consequently, the space between opposed rows of plated fingers along opposite facing edges of the board may vary producing a variation in the insertion and withdrawal forces of the card edge into the connector and the reliability with which mating surfaces engage one another. For certain applications, specifications require that a card edge connector mate with and reliably connect card edges varying in thickness from 0.054 inches to 0.071 inches. This must also be done within certain maximum push insertion force requirements for insertion of the card into the slot of the connector. These criteria impose severe limitations on the design of card edge connectors to meet them at minimum cost. The blade portion of the edge finger connector of the present invention presents a uniform desired thickness between conductive contacts for minimum insertion forces and a uniform overall rib thickness near the maximum acceptable to the card slot to hold the connection secure and motionless, all regardless of printed circuit board thickness. These features also greatly simplify the design of card edge connectors to be used with the edge finger connector of the present invention.

The use of conventional plated edge fingers on printed circuit boards also seriously limits the efficiency with which relatively small cards can be manufactured. That is, several smaller printed circuit boards are generally fabricated on a single substrate as parts of larger boards to maximize material handling efficiency and then cut into separate cards after processing is completed. The presence of edge fingers on the cards necessitates that the card circuitry be arranged so that all the edge portions of the cards lie along the edges of the large substrate to permit gold plating, a serious manufacturing limitation. Elimination of the plated gold fingers on the cards permits much more efficient arrangement of card circuitry on large substrates for substantial savings in processing costs.

Connectors having rows of spaced contact fingers for mounting to the edge of a printed circuit card have been developed. However, despite the fact that they eliminate the overall disadvantages of forming plated fingers on the card edge, these prior art edge connectors possess numerous disadvantages. For example, many of them include relatively bulky insulators which over-lie and enclose the edge of the printed circuit card and require expensive, time consuming installation means such as brads and bolts. Often such connectors are not adapted for engagement with a standard card edge connector but require a special mating connector half. Other prior art connectors, such as French Pat. No. 7,344,374, have similarly included a thin insulator strip to which flat transversely extending contact strips are held by tab portions which overlie sides of the strips leaving the tip ends thereof exposed. Protruding portions of the contact strips are soldered to the board wherein the insulator strip abuttingly engages the board edge. Such connectors are improvements over plated edge fingers but are not as reliable or as adapted to as rapid assembly and attachment to a printed circuit board edge as the connector of the present invention, as will be evident from the following disclosure.

Moreover, and most significantly, there has never been a reliable finger connector which can replace the use of plated edge finger terminations less expensively than the cost of the plated fingers. The connector of the present invention includes novel contact and insulator structual combinations which more reliable and less expensively obviate the need for plated edge finger terminations on printed circuit cards.

SUMMARY OF THE INVENTION

The invention relates to an interconnecting finger assembly for printed circuit boards having circuitry patterns formed thereon with a plurality of parallel, spaced conductive area extending transversely along one edge adapted for electrical interconnection. More particularly, the invention comprises a plurality of elongate, generally planar contact members having a first end portion adapted for electrical connection with the conductive circuitry of a printed circuit board and a second mating portion adapted for electrical connection with a connecting mating member and a shoulder portion therebetween. An insulative housing is also provided and includes a plurality of contact receiving sleeves. The housing is formed with inner and outer connecting regions. The inner region is formed by a slotted body portion, including a pair of opposed walls and a bottom having a plurality of recesses formed in the opposed walls in parallel spaced relationships. The recesses extend transversely of the house and form first inner sleeve portions for receiving the first contact end portions constructed for engagement with, and electrical connection to, the conductive circuitry of the printed circuit board. The insulative housing further including a depending blade portion comprising the outer connecting region wherein a plurality of outwardly facing, transversely extending recesses are formed in parallel spaced relationship. The recesses form second outer sleeve portions for receiving the second contact end portions for outwardly facing mating electrical engagement. The insulative housing also has a plurality of apertures formed through the bottom of the slotted body portion which interconnects each of the first and second sleeve portions and receives each of the contact shoulder portions.

In another aspect, the invention includes an improved electrical connector for a printed circuit board of the type having conductive strips which terminate along one edge in a parallel, transversely, extending spaced relationship. An insulative housing is provided and contains elongate contacts secured to the edge of the printed circuit board for affording electrical interconnection between the conductive strips and a connector member. The improvement comprises elongate contact members, each contact member including a first contact region adapted for positioning in facing engagement with the mating connector member. A generally Y-shaped insulative housing is provided and includes contact receiving sleeves formed therethrough. The insulative housing has an upper slotted head portion and a lower blade portion. The slotted head has a plurality of inwardly facing recesses forming an upper portion of the sleeves provided in transversely spaced relationship therein. Each of the recesses receives one of the contact members with the first region in inwardly facing engagement with one of the conductive strips. The lower blade portion of the insulative housing includes a plurality of outwardly facing recesses formed in generally parallel spaced relationship. Each of the recesses forms a lower portion of the sleeve and receives one of the contacts with the second contact region adapted for outwardly facing engagement with the mating member.

A feature of the invention is that two or more insulator housings may be placed end to end to form a longer connector while maintaining the contacts of each connector at equally spaced intervals.

BRIEF DESCRIPTION OF THE DRAWINGS

For a more complete understanding of the present invention and for further objects and advantages thereof, reference may now be had to the following description taken in conjunction with the accompanying drawing, in which.

DETAILED DESCRIPTION

Figure 1:
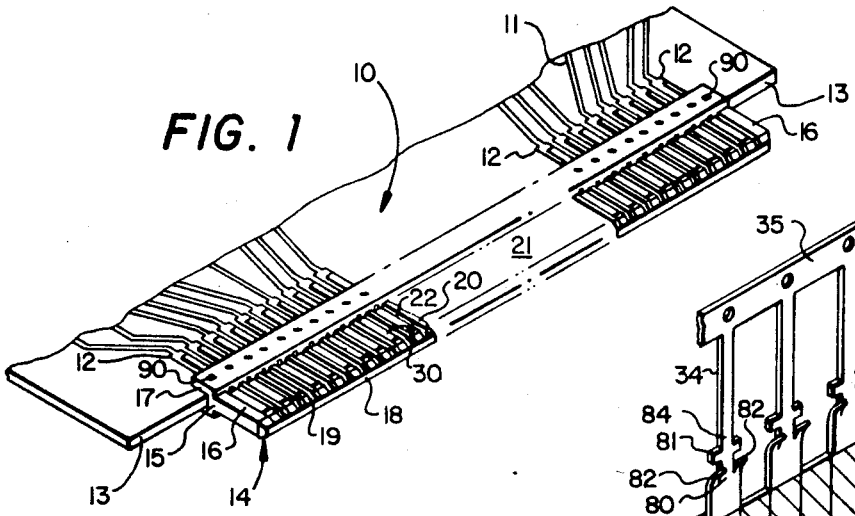
FIG. 1 is a perspective view of one embodiment of a printed circuit board edge connector constructed in accordance with the principles of the present invention.

Referring now to FIG. 1, there is shown a printed circuit board 10 which comprises a sheet of glass epoxy fiberglass laminate, often known as G-10 or FR-4. The printed circuit board material has been processed in the conventional manner so that a plurality of solder-coated copper conductors 11 are arranged on the board in a pre-selected pattern. The pattern is pre-selected to interconnect a plurality of circuit components which are mounted on the surfaces of the board (not shown) and also connect those components with circuitry external to the surface of the printed circuit board. The circuit points to be connected to circuitry external of the board include elongate solder-coated conductive strips 12 disposed parallel to and spaced from one another extending transversely along the linear edge 13 of the printed circuit board 10 on both the upper face and the lower face (not shown) of the board edge. The disclosure will use elongate rectangular conductive strips 12 as exemplary conductive circuit terminations along the board edge but it should be understood that these could consist of circular pads, dots or any other shape of conductive area to which the connector of the invention may be electrically joined, such as by solder. Disposed adjacent the edge 13 of the printed circuit board 10, is the printed circuit board edge connector of the present invention 14.

Figure 3:
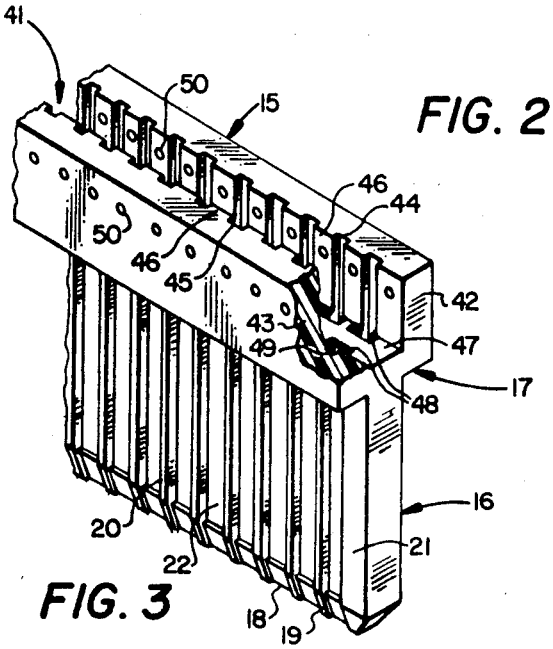
FIG. 3 is an enlarged, cut-away, perspective view of one embodiment of an insulator constructed in accordance with the teachings of the present invention.

Referring to both FIGS. 1 and 3, the connector 14 includes a molded insulator 15 which is generally Y-shaped in cross-section. The forked end of the insulator includes a slotted head section 17 which receives and engages the flat straight edge 13 of the printed circuit board 10. The head section 17 is attached to a flat blade section 16 which includes a lower edge 18 having a bevel 19 for guiding the connector into the card slot of a conventional printed circuit board card edge connector. The blade section 16 comprises generally flat front and rear surfaces 21 which include parallel transversely extending recesses 22 formed therein and separated from one another by raised ribs 20. The slotted head section 17 includes a pair of parallel upstanding walls 42 and 43, the inner faces of which are spaced from one another a distance slightly greater than the thickness of the printed circuit board 10. The inner faces of the walls also include transverse recesses 44 and 45 in axial alignment with the blade recesses 22 and connected thereto by apertures 48 in the head section as will be more fully explained below.

Elongate metal contacts 30 are received into each of the recesses 22 and extend through the apertures 48 in the head section 17, along the recesses 44 and 45 in the walls thereof, to be disposed in alignment with and overlying the solder coated conductive areas 12 along the front and rear surfaces of the board edge 13. The slot 41 of the slotted head section 17 of the connector 14 receives the edge 13 of the printed circuit board 10 is alignment in accordance with tooling holes on the board edge and aperatures 50 in the insulator and the contacts are soldered to the plated areas 12.

Figure 2:
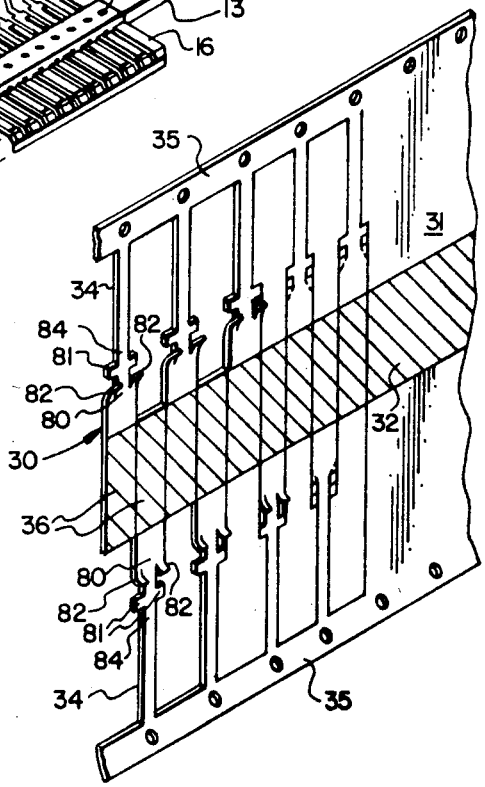
FIG. 2 is a perspective view of one embodiment of connector contacts constructed in accordance with the principles of the present invention.

Referring now to FIG. 2, there is shown a section of an elongate metal strip 31 illustrating the manner in which the contacts 30 of the present connector are preferably formed by stamping with a progressive die. The strip 31 is formed of a material such as a cupronickel alloy and then processed in accordance with well known techniques to inlay a gold band 32 on the upper face of the strip. A pair of similar tin-lead bands (not shown) are inlaid on the opposite face of the strip from the gold bands near the outer edges thereof. It should be noted that herein lies a very distinct advantage of the connector of the present invention; namely, that the contacts 30 are formed in a fashion whereby gold inlaying processes may be used to add the gold band 32 to the interconnecting regions of the contacts effectively and with very little waste. Such bands are of a gold which is much less porous and of a more consistent and higher quality than that of plated gold which is most often used on prior art electrical contacts. Thus, the gold material forming the inlayed band 32 allows many more board insertion cycles per given plating thickness than plated interconnection fingers conventionally formed along one edge of a printed circuit board.

The progressive die forms two interleafed rows of contacts, each elongate contact 30 comprising a narrow first tail region 34, which is frangibly attached to a carrier strip 35 left intact along each edge of the strip 31, and a broader paddle shaped head region 36. The head 36 and tail 34 are separated by a shoulder region 80. The shoulder region 80 includes a pair of generally rectangular upwardly facing shoulders 81 and a pair of upwardly facing transversely resilient lance portions 82 bent out of the plane of the paddle region 36. The neck section of joinder 84 between the tail region 34 and the shoulders 81 is bent first out of the plane of the paddle region 36 and then back toward that plane so that the longitudinal axis of the tail 34 lies at an angular offset from the longitudinal axis of the paddle 36, as best seen in the final contact configuration shown in FIG. 4.

As can be seen in FIG. 2, the gold inlaid band 32 is positioned with respect to the contacts 30 so that the gold region forms the electrical interconnecting portions of the contacts and the tin-lead regions on the opposite side (not shown) form the portions of the contacts along tail regions 34 to be joined to the edge of the printed circuit board. The interleafed contact arrangement of the flat pattern on the strip 31 insures maximum utilization of the gold inlaid material for electrical contacting regions. As pointed out above and shown in FIG. 4, during the stamping operation the contacts 30 are bent slightly about the neck section of joinder 84 so that the longitudinal axis of each carrier strip 35 is displaced a small angular offset from the longitudinal axis of each contact tail region 34. The function of this angular offset will be further explained below. After stamping, the two rows of contacts 30 are separated from one another and each comprises an elongate carrier strip 35 having a plurality of contacts extending transversely thereof and being attached to the strip at their narrower end 34 by a frangible, reduced section.

Referring specifically now to FIG. 3, there is shown a partially cut-away perspective view of the insulator portion 15 of the connector of the present invention. The insulator 15 is preferably formed by molding with conventional insulator materials such as a thermoplastic and includes a blade section 16 and a slotted head section 17 for receiving and engaging the edge of a printed circuit card. The insulator 15 is generally Y-shaped in cross-section. The forked card engaging head section 17 includes a printed circuit card receiving slot 41 formed by a pair of parallel upstanding walls 42 and 43 connected by a bottom surface 47 which physically abutts the edge of a printed circuit card when positioned in the insulator. The walls 42 and 43 are spaced from one another a distance slightly greater than the thickness of the mating printed circuit board to snuggly receive the edge of the board. The inner faces of the walls include a plurality of parallel, transversely extending recesses 44 and 45 separated from one another by ribs 46. Each recess 44 in wall 42 is transversely aligned with an opposing and facing recess 45 in wall 43. Each rib may include an optional circular aperture 50 extending coaxially through both walls of the head section for alignment and securement of the connector to the edge of the printed circuit board as will be discussed further below.

Extending from the head section 17, opposite the slot 41, is the blade section 16 which includes generally flat front and rear surfaces 21, each of which has formed therein a plurality of parallel transversely extending outwardly facing blade recesses 22. Each blade recess 22 is separated from an adjacent parallel recess by an upstanding rib 20. The heights of the ribs 20 are such as to provide an overall blade thickness approximately equal to the largest thickness of printed circuit card to be received into the card slot in a conventional card edge connector. Thus, the upstanding ribs 20 serve as self-centering means for the blade portion of the connector of the present invention. Each outwardly facing blade recess 22 is in general axial alignment with a conversely inwardly facing head wall recesses 44 or 45 and is connected thereto by a generally rectangular aperture 48 which passes through the bottom surface 47 of the head section 17 in alignment with the blade and head recesses. The aperture 48 include beveled upper edges to guide the insertion of contacts and a transversely extending, rectangular slot 49 which joins each aperture 48 to the slot 44 or 45 in the wall 42 or 43 at the juncture of the wall with the bottom 47. This allows the ready passage of contacts having an offset bend in the shoulder region as will be discussed below. Thus, the housing has a plurality of generally rectangular sleeves formed therein by the aligned combination of an inwardly facing rectangular head wall recess, a rectangular hole and a rectangular blade recess.

The lower ends of the blade slots 22 are squared and of a depth greater than the thickness of the contact blade 35 to shield and protect the ends thereof from damage during insertion of the connector blade into an edge connector slot. The lower edge 18 of the blade 16 includes bevels 19 which serve to guide the blade portion of the connector into a conventional printed circuit card edge connector slot.

Figure 4:
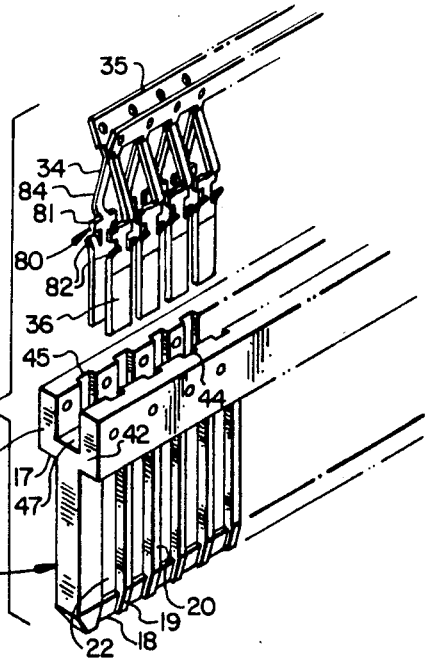
FIG. 4 is an exploded perspective view of the connector of FIG. 1, illustrating one method in which the connector of the present invention is assembled.
Figure 5:
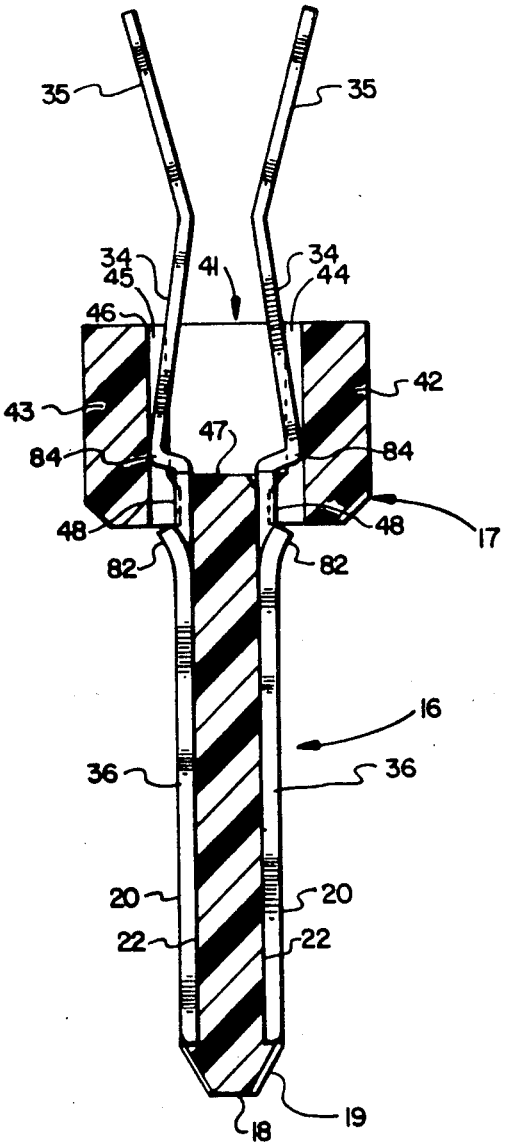
FIG. 5 is an end elevational, cross-section view of the connector assembly of the present invention.

Referring now to FIGS. 4 and 5, there is shown how the two opposed rows of contacts and the insulator 17 are brought together to form the connector assembly of the present invention. The two opposed rows of contacts are aligned with the angularly offset tail regions 34 and carrier strips 35 facing one another. Each of the contacts 30 are inserted into one for the insulator sleeves formed by an upper head recess 44, an aperture 48 and a blade recess 22. The blade portions 36 are inserted through the aperture 48 in the bottom 47 of the head section 17 and are moved down the blade recesses 22 until the contact blade tip reaches the lower end of each recess. At this point the shoulder 81 of the contacts 30 have moved into the apertures and the resilient lance sections 82 have moved through the apertures and sprung outwardly against the bottom of the head section, locking the contacts into the insulator. The transversely resilient contact tails 34 extend toward one another and are separated by a distance less than the thickness of the printed circuit board edge to which the connector is to be affixed. The connector assembly may be transported or stored and used subsequently by attachment to the printed circuit board edge as shown in FIG. 6.

Figure 6:
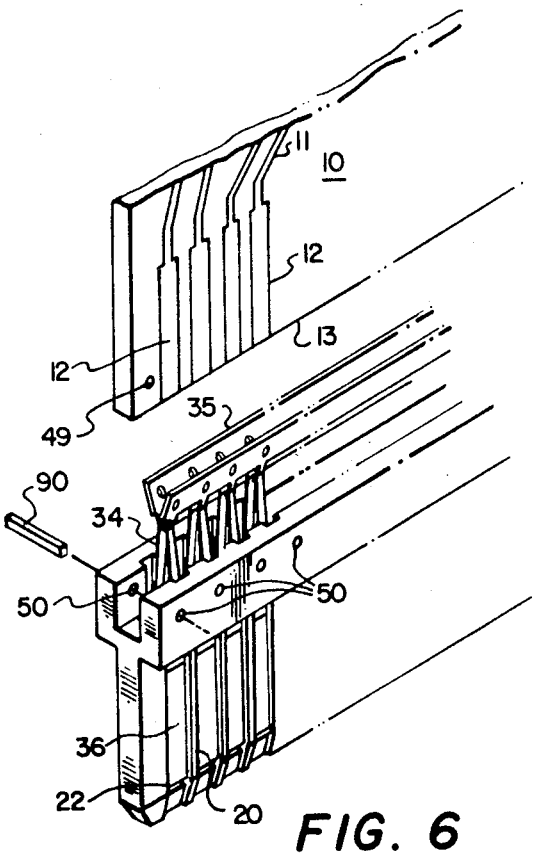
FIG. 6 is an exploded perspective view of the connector assembly of the present invention showing one method of attachment of the assembly to the edge of a printed circuit board.
Figure 7:
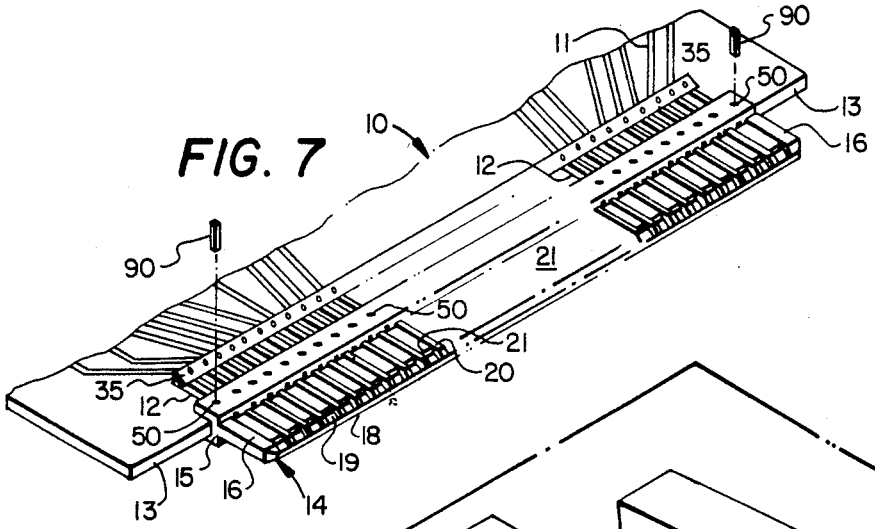
FIG. 7 is an enlarged perspective view of the assembled parts of FIG. 6.
Figure 10:
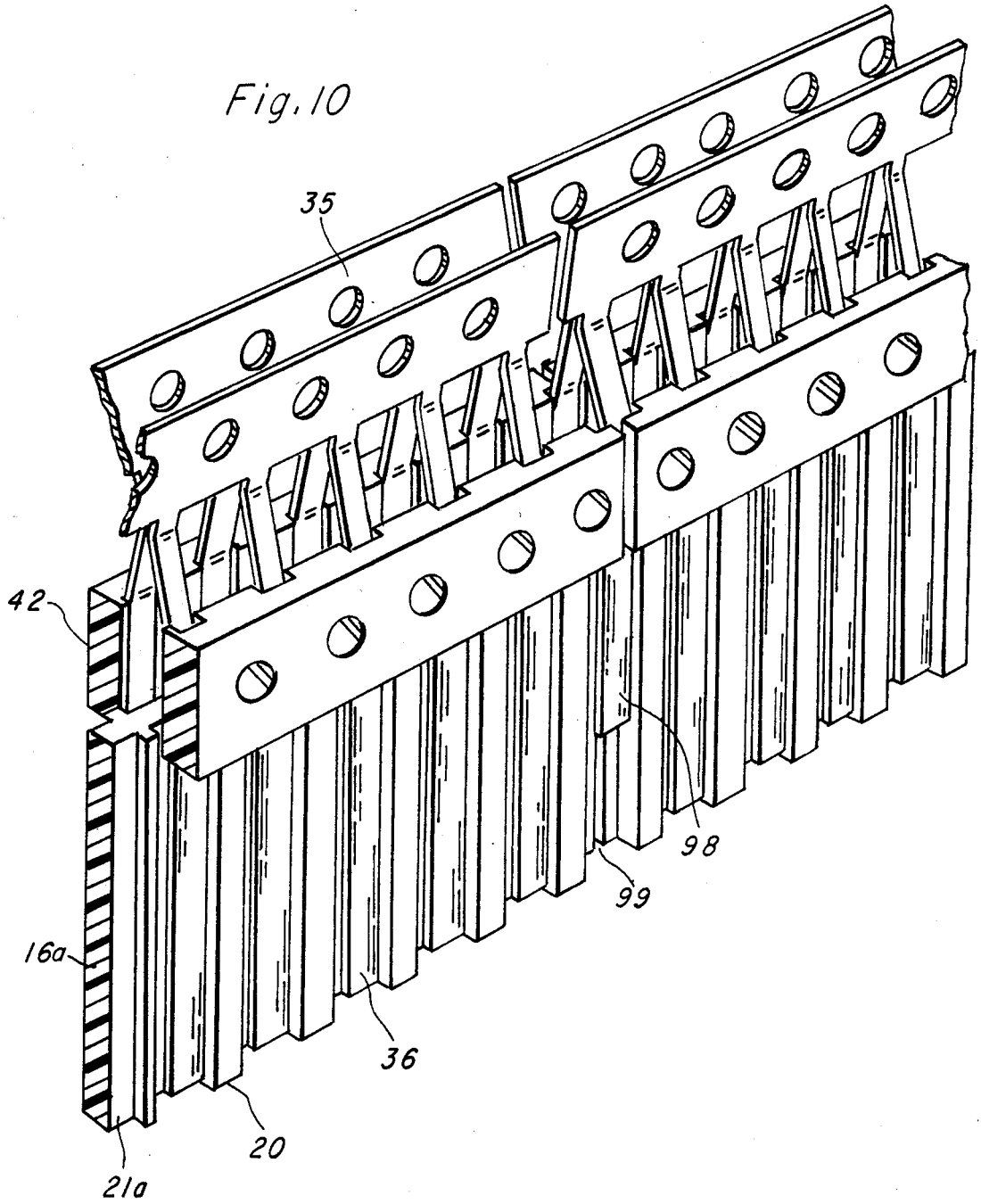
FIG. 10 is a pictorial illustration of two connectors placed end to end to form a longer connector.

As shown in FIG. 6, the insulator includes a plurality of transverse apertures 50, one between each of the sleeves 44 and 45, passing through the ribs 46. This feature allows the insulator 15 to be molded in one standard length and then cut to a selected number of contact positions in length to fit particular applications which produces a substantial saving in stocking costs. In addition, a plurality of insulators can be placed end-to-end to make especially long edge connections as illustrated in FIG. 10. In the mounting of the connector assembly to a printed circuit board edge, the solder coated conductive strip 12 on a printed circuit board 10 is brought into alignment with the connector by means of the apertures 50 in the insulator head and apertures 49 in the edge of the printed circuit board so that the upper tail portions 34 of each contact 30 is generally coaxially aligned with a conductive strip 12. As the two parts are brought together, the spring like action of the angularly offset contact tails must be overcome to move the board 10 between the rows of contacts. Thus, when the connector assembly has been fully positioned on the board edge, as shown in FIG. 7, the upper contact tail portions 34, having tin-lead material inlaid in the rear surfaces hereof, bear against the solder coated conductive strips with a spring biased force. This force brings the contact tails and the solder coated conductive strips into intimate facing engagement and is a valuable feature of the ease of assembly of the connector of the present invention.

Figure 11:
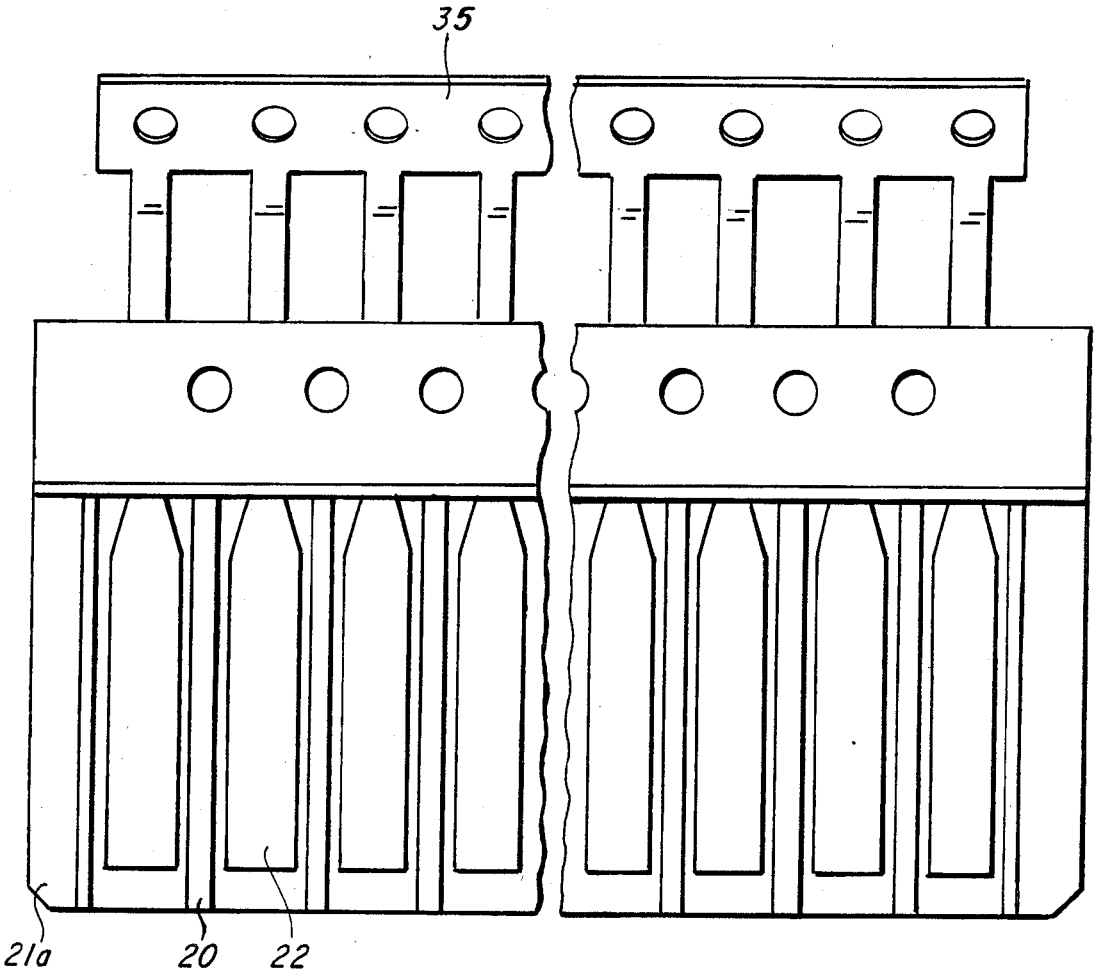
FIG. 11 is a front view of two connectors joined end to end.

Also illustrated in FIG. 7 is the manner in which optional square-wire posts 90 may be press-fitted through selected ones of the apertures 50 in the insulator and ones of the aligned apertures 49 in the edge of the positioned printed circuit board. The posts 90 may be used to provide strain relief for the mechanical solder connections between the connector contacts and the printed circuit board as required for certain MIL-spec connector applications. Further, the aperture 50 and 49 may also be used to key proper alignment and positioning between the connector and conductive circuitry along the edge of the printed circuit board. FIGS. 10 and 11 illustrate the connector of FIG. 2, FIG. 11 being a front view and FIG. 10 illustrating two connectors joined together to form a longer connector. Flat blade section **16*a* extends out each end of the connector. Blade section 16*a* has a recess 21*a* that is half the width of the blade sections or recesses 22 (FIGS. 4 and 6) and is not used unless two connectors are joined together to form a longer connector. When the two connectors are joined together, the ends of each connector are butted together and a contact blade 98 resides in the recess formed by two joined faces 21*a* and covers the line 99 where the two ends meet. The connectors are held together in the spaced relationship due to the fact that when the connectors are attached to a circuit board the connectors will not move in relation to each other. Any number of connectors may be placed end to end to form a longer connector since each connector has a half width recess 21*a* on each end. The connector contacts are then uniformly distributed along the connectors with a connector contact blade 98** covering the joint between adjacent connectors.

Figure 8:
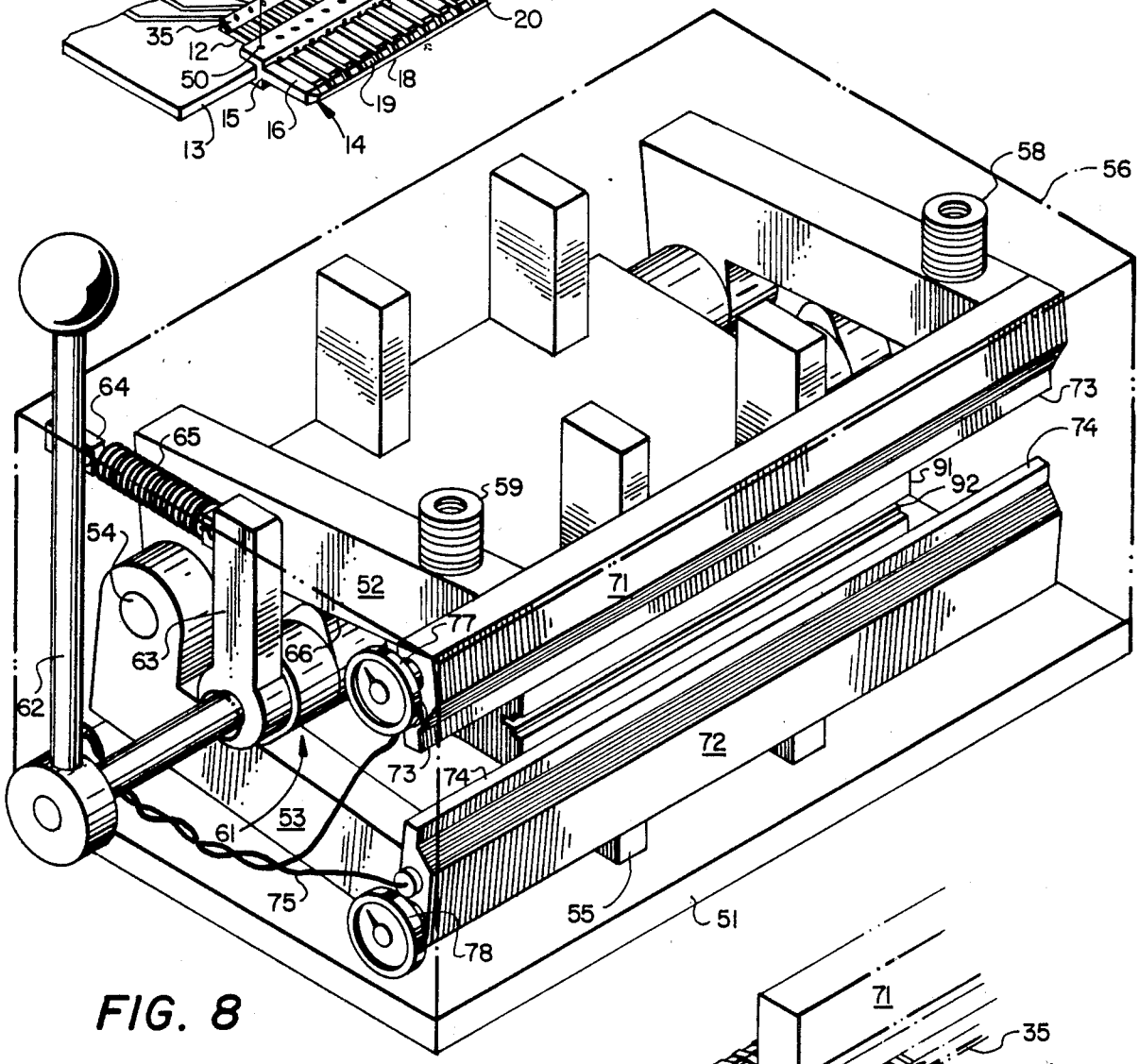
FIG. 8 is a perspective view of one embodiment of apparatus for soldering the assembled connector and board; and, FIG. 9 is a fragmentary perspective view of the connector assembly of FIG. 7 being assembled by the soldering apparatus of FIG. 8.

Referring now to FIG. 8, there is shown an apparatus for soldering the assembly of the printed circuit board and connector of the present invention. The apparatus comprises a mounting plate 51 onto which is mounted an upper arm 52 and a lower arm 53 which are pivoted to one another by means of a hinge 54. The lower arm 53 is rigidly mounted to the plate 51 by means of beams 55 while the entire assembly is preferrably mounted in a box-like structural housing 56 shown in phantom. The upper arm 52 is biased downwardly toward the lower arm 53 by means of a pair of helical springs 58 and 59 which abut the upper surface of the housing 56 to provide a continual spring biased urge of the arms toward one another. The arms 52 and 53 are separated from one another by means of cam mechanism 61 which is affixed to an external actuation arm 62 and an interior strut 63 which is spring biased to a mount 64 on the rear wall of the housing 56 by means of a helical spring 65. The actuation arm 62 is shown in the raised position and the radially extending lobe 66 on the cam mechanism 61 is extended toward the upper arm 52 and separates the arms from one another against the spring bias.

The front edge of the upper arm 52 includes an upper jaw member 71 while the lower arm 53 terminates in a lower jaw member 72. Each of the jaws respectively include an upper jaw edge 73 and a lower jaw edge 74. Mounted within each of the upper and lower jaw edges 73 and 74 are resistance heating mechanisms (not shown) which are conventional in nature and which are connected to a source of current by means of wires 75. An upper thermometer 77 and a lower thermometer 78 monitor the temperatures of the upper and lower jaw edges 73 and 74, respectively, to insure that the jaws have reached soldering temperature prior to actuation of the device.

Mounted between the jaws and spaced slightly out of the path thereof is a positioning fixture 91 which includes a recess 92 therein for receiving the blade edge of the connector of the present invention and positions it by means of the depth of recess 82 to insure engagement of the jaws with the proper portion of the assembly.

Figure 9:
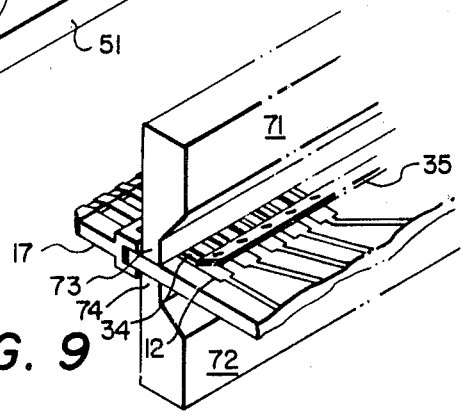

Referring now to FIG. 9, the upper and lower jaws 73 and 74 are shown in engagement with the assembly comprising the printed circuit board 10, the contacts 30 and the insulator 15. As can be seen, the jaws 73 and 74 lie flushly against the two mated surfaces which are in facing engagement to be joined; namely, the elongate solder coated conductive areas 12 on the upper and lower surfaces of the printed circuit board 10 and the tail portions 34 of the upper and lower rows of contacts 30. The heating mechanisms within the jaws 73 and 74 heats those surfaces to melt the solder carried by the conductive strips 12 and inlaid into the underside of the contact tails and join the strips to the contact tails 34. As was pointed out above, the opposed rows of contact tails 34 are bowed toward one another and, thus, the upper and lower surfaces of the printed circuit board 10. In this manner, when the solder is heated to melting temperature, the spring biased force holds the two parts in intimate engagement as the solder first flows and then is allowed to cool and solidify.

The finished printed circuit board and finger connector combination is then completed by removing the upper and lower contact carrier strips 35 by flexing them about the point of joinder to the contact tails 34. This action breaks the reduced sections therebetween and separates the strips from the assembly.

A completed connector and printed circuit board assembly may then be sued in the identical fashion as a printed circuit board having plated edge fingers. The connector contacts form an interconnection between the board and a printed circuit board edge connector; that is, the gold inlaid outer surfaces of the contact portions 36 will matingly engage the cantilever contact members of a conventional card edge connector. It should also be understood that the sleeves and contacts may for special applications, be staggered on the insulator or made of different lengths to provide for sequential or selective interconnection with the contacts of the card edge connector.

The printed circuit board finger connector of the present invention may not only be used to make connection with new printed circuit boards but may also be used highly effectively to repair printed circuit boards having old or damaged plated edge fingers. The contact tail portions 34, of the connector assemblies of FIGS. 6 and 7, are joined to the plated edge fingers of a board to be repaired just as they are joined to the plated conductive strips 12 of the printed circuit board 10. Moreover, the spring biased contact tails 34 bear against the plated fingers and aid the soldering process by holding the parts to be joined in the engagement as solder is added. This feature permits the salvage of expensive fully fabricated and tested printed circuit boards which would otherwise be scrapped for defective construction or plating of the edge finger terminations.

In summary, the printed circuit card finger connector of the present invention provides many advantages over the use of plated contact fingers along the edge of a printed circuit board and further includes many advantages over the prior art finger connectors. Several contact finger assemblies may be placed end to end along the edge of a printed circuit board to provide longer card edge connectors and still maintain the original connector spacing. It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. An improved electrical connector for a printed circuit board of the type having conductive circuitry areas formed thereon and terminating along one edge thereof in a transversely extending spaced relationship and wherein an insulating housing containing elongated contacts is secured to the edge of said printed circuit board for affording electrical interconnection between said conductive circuitry and mating connector member, characterized by elongated contact members, each elongated contact member including a first contact region adapted for positioning in facing engagement with said conductive circuitry of said printed circuit board and a second contact region adapted for positioning in facing engagement with said mating connector member;

the insulating housing being generally Y-shaped and having contact receiving sleeves formed therethrough, said insulating housing having an upper slotted head portion for receiving the edge of a printed circuit board and a lower blade portion for engaging a mating connector member, said slotted head portion including opposed walls having a plurality of inwardly facing recesses provided in parallel transversely spaced relationship therein and forming an upper portion of said sleeves, each of said recesses receiving one of said contact members with said first region positioned for inwardly facing engagement with one of the conductive areas on the edge of a printed circuit board inserted into the slot of the head portion; and said lower blade portion of said insulating housing having a plurality of outwardly facing recesses formed in generally parallel spaced relationship, each of said recesses forming a lower portion of said sleeve and receiving one of said elongated contacts with said second contact region adapted for outwardly facing engagement with said mating member, and each end of said lower blade portion having a recess half the size of one of said outwardly facing recesses so that two or more connectors when placed end to end from a full recess between two adjoining connectors.

2. An improved electrical connector for a printed circuit board as set forth in claim 1 characterized in that each of said elongate contact members (30) is formed with the longitudinal axis of the first contact region (34) lying at a slight angle relative to the longitudinal axis of the second contact region to produce a spring biasing force urging the first contact region into facing engagement with the conductive areas along the edge of a printed circuit board positioned within the slot of said head portion.

3. An improved electrical connector for a printed circuit board as set forth in claim 1 characterized in that the outwardly facing surfaces of said second contact regions (36) includes a band (32) of gold extending transversely thereacross.

4. An improved electrical connector for a printed circuit board as set forth in claim 1 characterized in that the contact receiving sleeves (44,45,48) are generally rectangular in cross sectional configuration and wherein the inwardly and outwardly facing recesses forming said sleeves are interconnected by generally rectangular apertures extending through the bottom of the slotted head portion, and that there is a generally rectangular half sleeve corresponding to each half recess on each end of the electrical connector.

5. An improved electrical connector for a printed circuit board as set forth in claim 1 characterized in that the lower blade portion of the insulative housing is adapted for engagement with a conventional printed circuit card connector and wherein the outwardly facing recesses are each separated from one another by parallel ribs (19), the height of said ribs being selected to produce an effective thickness of said blade portion which approximates the largest thickness of printed circuit card to be received by the card slot of said conventional card edge connector to align said blade in the connector.

* * * * *